US008864273B2

(12) United States Patent
Hori

(10) Patent No.: US 8,864,273 B2
(45) Date of Patent: Oct. 21, 2014

(54) IMAGE RECORDING APPARATUS, IMAGE RECORDING METHOD, PROGRAM AND PROGRAM RECORDING MEDIUM

(71) Applicant: Seiko Epson Corporation, Tokyo (JP)

(72) Inventor: Naoki Hori, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/865,455

(22) Filed: Apr. 18, 2013

(65) Prior Publication Data

US 2013/0278666 A1 Oct. 24, 2013

(30) Foreign Application Priority Data

Apr. 24, 2012 (JP) ..... 2012-098776

(51) Int. Cl.

| | |
|---|---|
| ***B41J 29/38*** | (2006.01) |
| ***B41J 29/393*** | (2006.01) |
| ***B41J 2/01*** | (2006.01) |
| ***B41J 15/16*** | (2006.01) |

(52) U.S. Cl.

CPC ..... *B41J 15/16* (2013.01); *B41J 15/165* (2013.01)

USPC ..... 347/16; 347/19; 347/101; 347/104; 347/105

(58) Field of Classification Search

USPC ..... 347/16, 101, 104–105, 19

See application file for complete search history.

(56) References Cited

U.S. PATENT DOCUMENTS

| | | | | |
|---|---|---|---|---|
| 6,028,614 | A * | 2/2000 | Clark | 347/112 |
| 2011/0128338 | A1* | 6/2011 | DeCook et al. | 347/104 |
| 2012/0224009 | A1* | 9/2012 | Kasiske et al. | 347/102 |

FOREIGN PATENT DOCUMENTS

| | | | |
|---|---|---|---|
| JP | 04-094357 | A | 3/1992 |
| JP | 2005-074773 | A | 3/2005 |

* cited by examiner

*Primary Examiner* — Jason Uhlenhake

(74) *Attorney, Agent, or Firm* — Global IP Counselors, LLP

(57) ABSTRACT

An image recording apparatus includes a recording unit that records an image in a first region, a first control unit that has a drive roller to transport a recording medium and controls a tension of the recording medium in the first region by adjusting a torque of the drive roller based on the tension of the recording medium in the first region, a second control unit that controls the tension of the recording medium in a second region according to the detection result of the tension of the recording medium in the second region. Compared to the frequency response characteristics of the first control unit with respect to the tension fluctuations generated in the first region, the frequency response characteristics of the second control unit with respect to the tension fluctuations generated in the second region responds to the tension fluctuations having a higher frequency band.

12 Claims, 5 Drawing Sheets

| GAIN | PROCESS UNIT | ROLL UNIT |
|---|---|---|
| Kp (PROPORTIONAL) | 0 | Cp |
| Ki (INTEGRAL) | Bi | Ci |
| Kd (DIFFERENTIAL) | 0 | 0 |

IMAGE RECORDING APPARATUS, IMAGE RECORDING METHOD, PROGRAM AND PROGRAM RECORDING MEDIUM

CROSS-REFERENCE TO RELATED APPLICATIONS

The entire disclosure of Japanese Patent Application No. 2012-098776, filed Apr. 24, 2012 is expressly incorporated by reference herein.

BACKGROUND

1. Technical Field

The present invention relates to a technology for recording an image with respect to a recording medium, particularly to a technology for controlling a tension applied to the recording medium.

2. Related Art

JP-A-2005-074773 discloses an image recording apparatus which records an image with respect to a transported sheet. Specifically, the sheet is transported by a rotation of two drive rollers on which the sheet is stretched. Then, a recording head facing the recording medium in between the drive rollers records the image with respect to the sheet transported from an upstream side to a downstream side of the transportation path. In addition, in JP-A-2005-074773, a sheet transportation speed by the upstream side drive roller is set to be faster than a sheet transportation speed of the downstream side drive roller. As a result, the sheet is pulled to the downstream side drive roller and the tension is applied to the sheet.

Furthermore, JP-A-04-094357 discloses a reeling and feeding apparatus which applies the tension to the transported sheet by a different method from the method disclosed in JP-A-2005-074773. In the reeling and feeding apparatus, both ends of the sheet is wound around a reel shaft and a roll shaft, the sheet is transported from the reel shaft to the roll shaft by rotations of the reel shaft and the roll shaft. Then, the tension is applied to the sheet by controlling a torque of the reel shaft. Particularly, in JP-A-04-094357, the tension to the sheet can be controlled by controlling the torque of the reel shaft based on a detection result of the tension to the sheet.

Incidentally, as the image recording apparatus disclosed in JP-A-2005-074773, in a configuration where a tension is applied to a recording medium (a sheet) by providing a difference in transportation speed of two drive rollers, there occurs a slip between a downstream side of the drive roller and the recording medium and the recording medium is easily flapping up and down. When such a flap occurs in a process region where an image is recorded on the recording medium, the image cannot be properly recorded on the recording medium. Therefore, it is conceivable to apply the technology disclosed in JP-A-04-094357 to the image recording apparatus disclosed in JP-A-2005-074773. That is, by adjusting a torque of the drive roller based on a detection result of the tension of the recording medium in the process region, it is expected that the flapping is suppressed and the tension can be applied to the recording medium in the process region.

However, in the case where a combination of technologies in JP-A-2005-074773 and JP-A-04-094357 is attempted like this, there has been a possibility that the tension of the recording medium becomes unstable in the process region. That is, in a configuration where a torque control is performed with respect to the drive roller, tension fluctuations may be transmitted to each other between the two regions which interpose the drive roller. Accordingly, since the torque control is applied to the drive roller, the tension fluctuations of the recording medium that occurs in the reverse side of the drive roller to the process region is transmitted to the recording medium in the process region. In this case, the tension fluctuations with a high frequency that occurs in the reverse side of the drive roller is transmitted to the process region to disturb the tension control in the process region, thus the tension of the recording medium in the process region vibrates and becomes unstable, and consequently, there has been a possibility that the image recording on the recording medium cannot be properly performed.

SUMMARY

An advantage of some aspects of the invention is to provide a technology by which the proper image recording can be performed by stabilizing the tension of the recording medium in the region where the image recording on the recording medium is performed.

According to an aspect of the invention, there is provided an image recording apparatus including; a recording unit that records an image on a recording medium in a first region; a first control unit that has a drive roller to transport the recording medium, and that controls a tension of the recording medium in the first region by adjusting a torque of the drive roller based on a detection result of the tension of the recording medium in the first region; a second control unit that controls the tension of the recording medium in a second region according to the detection result of the tension of the recording medium in the second region which is in an opposite side interposing the recording unit with respect to the drive roller. Compared to the frequency response characteristics of the first control unit with respect to the tension fluctuations generated in the first region, the frequency response characteristics of the second control unit with respect to the tension fluctuations generated in the second region respond to the tension fluctuations having a higher frequency band.

According to another aspect of the invention, there is provided an image recording method in which an image is recorded on a recording medium, the method includes; first controlling a tension of the recording medium in a first region by adjusting a torque of the drive roller which transports the recording medium based on a detection result of a tension of the recording medium in a first region where an image recording is performed on the recording medium, and second controlling the tension of the recording medium in a second region according to the detection result of the tension of the recording medium in a second region which is in an opposite side interposing the recording unit with respect to the drive roller. Compared to the frequency response characteristics represented by the tension control in the first controlling with respect to the tension fluctuations generated in the first region, the frequency response characteristics represented by the tension control in the second controlling with respect to the tension fluctuations generated in the second region respond to the tension fluctuations having a higher frequency band.

According to still another aspect of the invention, there is provided a program used for a computer that controls an image recording apparatus which records an image on a recording medium, the program causes the computer to function as; a first control unit that controls a tension of the recording medium in a first region by adjusting a torque of a drive roller which transports the recording medium based on a detection result of a tension of the recording medium in a first region where an image recording is performed on the recording medium, and a second control unit that controls the tension of the recording medium in a second region according to a detection result of the tension of the recording medium in a second region which is in an opposite side interposing the recording unit with respect to the drive roller. The program causes the computer to function so that; compared to the frequency response characteristics of the first control unit with respect to the tension fluctuations generated in the first region, the frequency response characteristics of the second control unit with respect to the tension fluctuations generated in the second region respond to the tension fluctuations having a higher frequency band.

According to still another aspect of the invention, there is provided a program recording medium in which the program is recorded and can be read by the computer.

In the aspects configured in this way (the image recording apparatus, the image recording method, the program and the program recording medium), the tension of the recording medium in the first region is controlled by adjusting a torque of the drive roller based on a detection result of the tension of the recording medium in the first region where the image recording on the recording medium is performed (that is, process region). In addition, the tension of the recording medium in the second region is controlled according to the detection result of the tension of the recording medium in the second region which is in an opposite side of the recording unit from the drive roller (that is, a region opposite to the process region from the drive roller). In other words, in each of the first region and the second region which interposes the drive roller therebetween, the tension control of the recording medium is performed according to detection result of the tension of the recording medium.

Then, the aspect is configured such that, compared to the frequency response characteristics of the tension control in the first region, the frequency response characteristics of the tension control in the second region respond to the tension fluctuations having a higher frequency band. As a result, the control can be performed in such a manner that, the tension control with respect to the slow response characteristics in the first region does not respond to the tension fluctuations with high frequency, and only the tension with the fast response characteristics with respect to the second region respond to the tension fluctuations with high frequency. Accordingly, even though the tension fluctuations with high frequency generated in the opposite side of the drive roller (the second region) is transmitted to the first region (the process region), a disturbance of the tension control by this tension fluctuations with respect to the first region can be suppressed, and as a result, a situation can be suppressed in which a vibration of the tension of the recording medium in the first region is generated. In this way, in the region where the image recording on the recording medium is performed (the first region), the tension of the recording medium is stabilized, thus a proper image recording can be performed.

In addition, it may be configured such that the aspect is applied to an image recording apparatus having a periodic fluctuation component in which the tension of the recording medium in the second region fluctuates periodically. In this way, an influence of the periodic fluctuation component generated in the tension of the recording medium in the second region is suppressed and the tension of the recording medium in the first region is stabilized. Thus, a proper image recording can be performed.

In this case, the image recording apparatus may be configured such that the frequency response characteristics of the first control unit do not respond to the tension fluctuations with the frequency of periodic fluctuation component. In this configuration, even though the periodic fluctuation component generated in the tension of the recording medium in the second region is transmitted to the recording medium in the first region, the tension control with respect to the first region does not respond to the periodic fluctuation component. Accordingly, since the periodic fluctuation component disturbs the tension control with respect to the first region, a situation can be effectively suppressed in which a vibration of the tension of the recording medium in the first region is generated.

In addition, the image recording apparatus may be configured such that the frequency response characteristics of the second control unit respond to the tension fluctuations with the frequency of the periodic fluctuation component. In this configuration, the periodic fluctuation component generated in the tension of the recording medium in the second region can be properly suppressed using the tension control with respect to the second region. Thus, the tension of the recording medium in the second region can be stabilized.

In addition, the above configuration may be applied to the image recording apparatus in which the drive roller transports the recording medium from the first region to the second region. The apparatus further includes a roll shaft that rotates and rolls the recording medium in the second region. The tension of the recording medium in the second region has a periodic fluctuation component which varies in a rotation period of the roll shaft.

Alternatively, the above configuration may be applied to the image recording apparatus in which the drive roller transports the recording medium from the second region to the first region. The apparatus further includes a feeding shaft that rotates and feeds the recording medium in the second region. The tension of the recording medium in the second region has a periodic fluctuation component in which the tension fluctuates in a rotation period of the feeding shaft.

In addition, in the image recording apparatus, it may be configured such that the apparatus further includes a driven rotary member which comes in contact with the recording medium on which the image is formed on the recording unit in the first region and rotates by being driven by the transported recording medium. In this way, the recording medium is supported in the first region by the driven rotary member being driven to rotate by the transported recording medium. Thus, the tension of the recording medium in the first region can be more stabilized.

In the image recording apparatus, it may be configured such that the first control unit detects the tension of the recording medium, in between the driven rotary member and the drive roller.

By the way, in the aspect, the apparatus may be configured such that, compared to the frequency response characteristics of the tension control in the first region, the frequency response characteristics of the tension control in the second region respond to the tension fluctuations having a higher frequency band. As a specific mechanism to achieve such a configuration, a variety of aspects can be employed.

Here, in the image recording apparatus, it may be configured such that the first control unit controls the tension of the recording medium in the first region by performing only an integral action among the integral action, a proportional action and a differential action, with respect to a detection result of the tension fluctuations of the recording medium, and the second control unit controls the tension of the recording medium in the second region by performing other than the integral action with respect to a detection result of the tension fluctuations of the recording medium.

Alternatively, in the image recording apparatus, it may be configured such that the first control unit includes a filter that transfers only a frequency band with a frequency equal to or less than the predetermined value, to a feedback loop which returns the detection result of the tension fluctuations of the recording medium to the torque of the drive roller.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
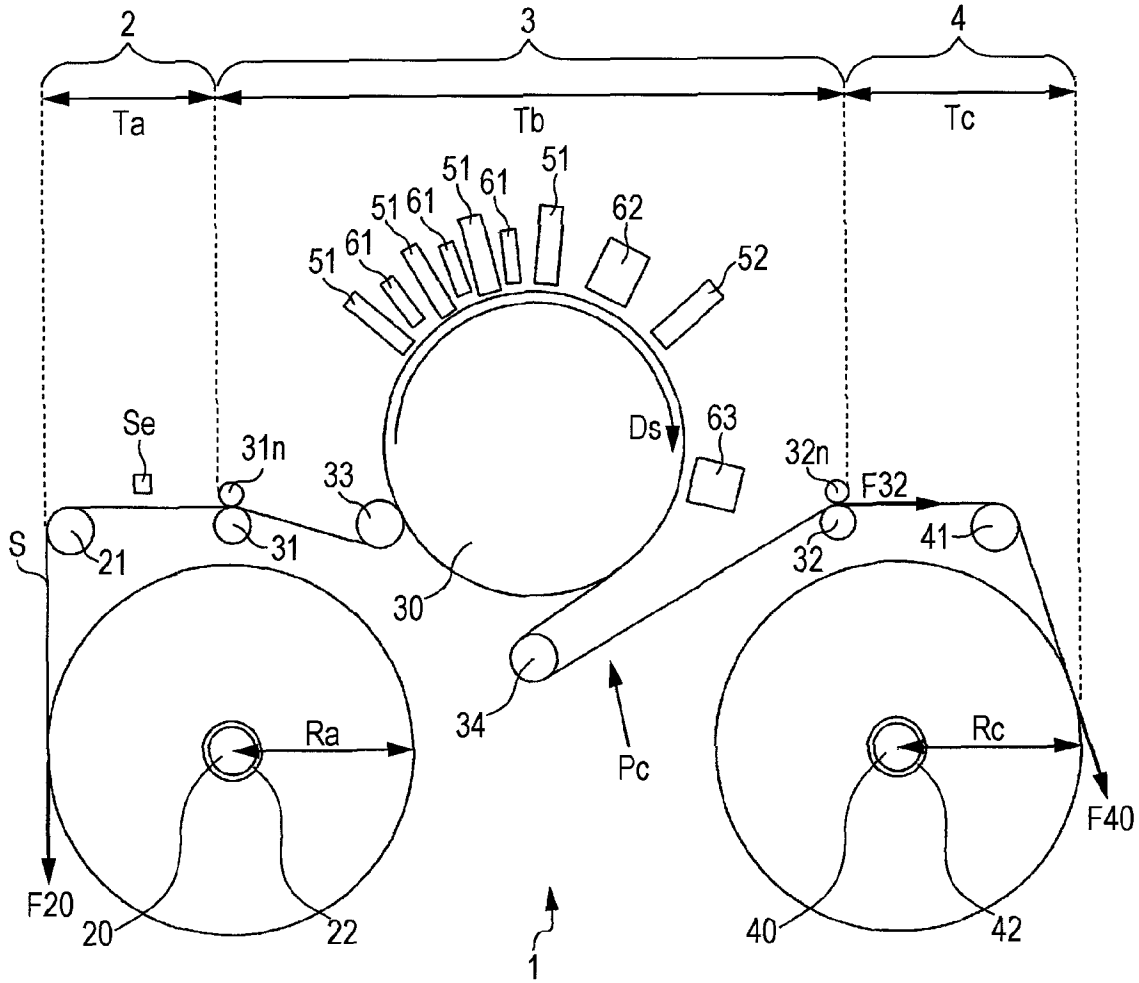
FIG. 1 is a schematic diagram illustrating an example of a configuration of an apparatus included in a printer to which the invention is applicable.

FIG. 1 is a schematic front view illustrating an example of a configuration of an apparatus included in a printer to which the invention is applicable. As illustrated in FIG. 1, in the printer 1, a single sheet S (web) both ends of which are wound in roll shapes in a feeding shaft 20 and a roll shaft 40 is stretched between the feeding shaft 20 and the roll shaft 40, the sheet S is transported from the feeding shaft 20 to the roll shaft 40 along such a stretched path Pc. Then, in printer 1, an image is recorded with respect to the sheet S transported along the transportation path Pc. The type of the sheet S is broadly divided into paper-based sheet and film-based sheet. As a specific example, a high-quality paper sheet, a cast paper, an art paper and a coated paper are included in the paper-based sheet. A synthetic paper, PET (Polyethylene terephthalate) and PP (polypropylene) are included in the film-based sheet. Schematically, the printer 1 includes a feed unit 2 (a feed region) which feeds the sheet S from the feed shaft 20, a process unit 3 (a process region) which records the image on the sheet S fed from the feed unit 2, and a roll unit 4 (roll region) which rolls the sheet S on which the image is recorded in the process unit 3 to the roll shaft 40. Moreover, in the description below, among both ends of the sheet S, a side where the image is recorded is referred as a surface while the opposite side thereof is referred as a rear surface.

The feed unit 2 includes the feeding shaft 20 in which one end of the sheet S is wound and a driven roller 21 in which the sheet S pulled out from the feeding shaft 20 is wound. The feeding shaft 20 winds and supports the end of the sheet S in a state where the surface of the sheet S is facing the outside. Then, by the rotation of the feeding shaft 20 in a clockwise direction in FIG. 1, the sheet S wound in the feeding shaft 20 is fed to the process unit 3 via the driven roller 21. Incidentally, the sheet S is wound in the feeding shaft 20 via a core tube 22 freely detachably attached to the feeding shaft 20. Accordingly, when the sheet S in the feeding shaft 20 is exhausted, the sheet S in the feeding shaft 20 can be replaced by mounting a new core tube 22 where the roll-shaped sheet S is wound, to the feeding shaft 20.

The process unit 3 supports the sheet S fed from the feed unit 2 in a platen drum 30 and records the image on the sheet S by performing the appropriate processes by each function unit 51, 52, 61, 62 and 63 which are disposed along the outer peripheral surface of the platen drum 30. In the process unit 3, a front drive roller 31 and a rear drive roller 32 are provided on both sides of the platen drum 30, the sheet S transported from the front drive roller 31 to the rear drive roller 32 is supported by the platen drum 30 and receives the image recording.

The front drive roller 31 has a plurality of minute projections formed by a thermal spray around the outer peripheral surface, and winds the sheet S fed from the feed unit 2, from the rear surface side thereof. Then, by the rotation of the front drive roller 31 in a clockwise direction in FIG. 1, the sheet S fed from the feed unit 2 is transported to the down-stream side of the transportation path. Moreover, a nip roller 31*n* is provided with respect to the front drive roller 31. The nip roller 31*n* comes in contact with the surface of the sheet S in a state of being biased toward the front drive roller 31 side, and interposes the sheet S between the front drive roller 31 and the nip roller 31*n*. Accordingly, the frictional force between the front roller 31 and the sheet S can be secured, and the transportation of the sheet S by the front drive roller 31 can be reliably performed.

The platen drum 30 is a cylindrical shaped drum which is supported to rotate by a supporting mechanism (not illustrated) and has a diameter of 400 mm for example. The platen drum 30 winds the sheet S transported from the front drive roller 31 to the rear drive roller 32, from the rear surface side. The platen drum 30 is driven to rotate in a transportation direction Ds of the sheet S with a frictional force between the sheet S and the platen drum 30, and supports the sheet S from the rear surface side. Incidentally, in the process unit 3, the driven rollers 33 and 34 which fold back the sheet S in both sides of the winding unit to the platen drum 30. The driven roller 33 winds the surface of the sheet S in between the front drive roller 31 and the platen drum 30 to fold back the sheet S. On the other hand, the driven roller 34 winds the surface of the sheet S in between the platen drum 30 and the rear drive roller 32 to fold back the sheet S. In this way, the elongated winding unit can be secured for winding the sheet S to the platen drum 30 by folding back the sheet S in each of up-stream and the down-stream of the transportation direction Ds with respect to the platen drum 30.

The rear drive roller 32 has a plurality of minute projections formed by a thermal spray around the outer peripheral surface, and winds the sheet S fed from the platen drum 30 via the driven roller 34, from the rear surface side thereof. Then, by the rotation of the rear drive roller 32 in a clockwise direction in FIG. 1, the sheet S is transported to the roll unit 4. Moreover, a nip roller 32*n* is provided with respect to the rear drive roller 32. The nip roller 32*n* comes in contact with the surface of the sheet S in a state of being biased toward the rear drive roller 32 side, and interposes the sheet S between the rear drive roller 32 and the nip roller 31*n*. Accordingly, the frictional force between the rear roller 32 and the sheet S can be secured, and the transportation of the sheet S by the rear drive roller 32 can be reliably performed.

In this way, the sheet S transported from the front drive roller 31 to the rear drive roller 32 is supported to the outer peripheral side of the platen drum 30. Then, in the process unit 3, in order to record the color image with respect to the surface of the sheet S supported to the platen drum 30, a plurality of recording heads 51 corresponding to the colors different from each other. Specifically, four recording heads 51 corresponding to each color of yellow, cyan, magenta and black are aligned in the transportation direction Ds in this color order. Each of the recording heads 51 is facing, with a slight clearance, the surface of the sheet S wound around the platen drum 30, and ejects the ink corresponding to each color (color ink) from the nozzles using an ink jet method. Then, the color image is formed on the surface of the sheet S by ejecting the ink from each of the recording heads 51 with respect to the sheet S transported in the direction Ds.

Incidentally, as the ink, an UV (ultraviolet) ink (a light curable ink) cured by irradiating the ultraviolet light is used. Then, in the process unit 3, in order to cure the ink and fix it on the sheet S, UV lamps 61 and 62 (a light irradiation unit) are provided. Moreover, the ink curing is performed in two stages, pre-curing and main curing. Between each of the recording heads 51, UV lamps 61 for pre-curing are disposed. That is, UV lamp 61 irradiates a weak ultraviolet light to cure the ink to the extent that the shape of the ink is not collapsed (pre-curing), and does not completely cure the ink. On the other hand, in the down-stream side of the transportation direction Ds with respect to the plurality of recording heads 51, the UV lamp 62 for main curing is provided. That is, the UV lamp 62 irradiates a stronger ultraviolet light than the UV lamp 61 does, and completely cures the ink (main curing).

In this way, UV lamps 61 disposed between each of the recording heads 51 pre-cures the color ink ejected from the recording head 51 to the sheet S on the up-stream side of the transportation direction Ds. Accordingly, the ink ejected from one recording head 51 to the sheet S is pre-cured until arriving at the recording head 51 adjacent to one recording head 51 in the down-stream side of the transportation direction Ds. In this way, an occurrence of color mixing in which the color ink with different colors are mixed can be suppressed. In a state where the color mixing is suppressed in this way, the color image is formed on the sheet S by ejecting the color ink with the colors different from each other by the plurality of recording heads 51. Furthermore, in the down-stream side of the transportation direction Ds with respect to the plurality of recording heads 51, the UV lamp 62 for main curing is provided. Therefore, the color image formed by the plurality of recording heads 51 is main-cured by the UV lamp 62 and fixed on the sheet S.

Furthermore, in the down-stream side of the transportation direction Ds with respect to the UV lamp 62, the recording head 52 is provided. The recording head 52 is facing, with a slight clearance, the surface of the sheet S wound around the platen drum 30, and ejects a transparent UV ink from the nozzle to the surface of the sheet S using the ink jet method. That is, with respect to the color image formed by the recording heads 51 for four colors, the transparent ink is further ejected. The transparent ink is ejected on the whole surface of the color image to give a texture such as a gloss or a matte to the color image. In addition, in the down-stream side of the transportation direction Ds with respect to the recording head 52, the UV lamp 63 is provided. The UV lamp 63 irradiates a strong ultraviolet light to completely cure the transparent ink ejected from the recording head 52 (main curing). In this way, the transparent ink can be fixed on the surface of the sheet S.

In this way, in the process unit 3, the color image coated by the transparent ink is formed by properly performing the ink ejection and the curing with respect to the sheet S wound around the outer peripheral part of the platen drum 30. Then, the sheet S on which the color image is formed is transported to the roll unit 4 by the rear drive roller 32.

The roll unit 4 has a driven roller 41 winding the sheet S from the rear surface side in between the roll shaft 40 and the rear drive roller 32, in addition to the roll shaft 40 winding the edge of the sheet S. The roll shaft 40, in a state where the surface of the sheet S facing the outer side, rolls the edge of the sheet S to support. That is, when the roll shaft 40 rotates clockwise in FIG. 1, the sheet S transported from the rear drive roller 32 is rolled to the roll shaft 40 via the driven roller 41. Incidentally, the sheet S is rolled to the roll shaft 40 via the core tube 42 detachably attached to the roll shaft 40. Accordingly, when the sheet S is fully rolled to the roll shaft 40, the sheet S can be detached together with the core tube 42.

Figure 2:
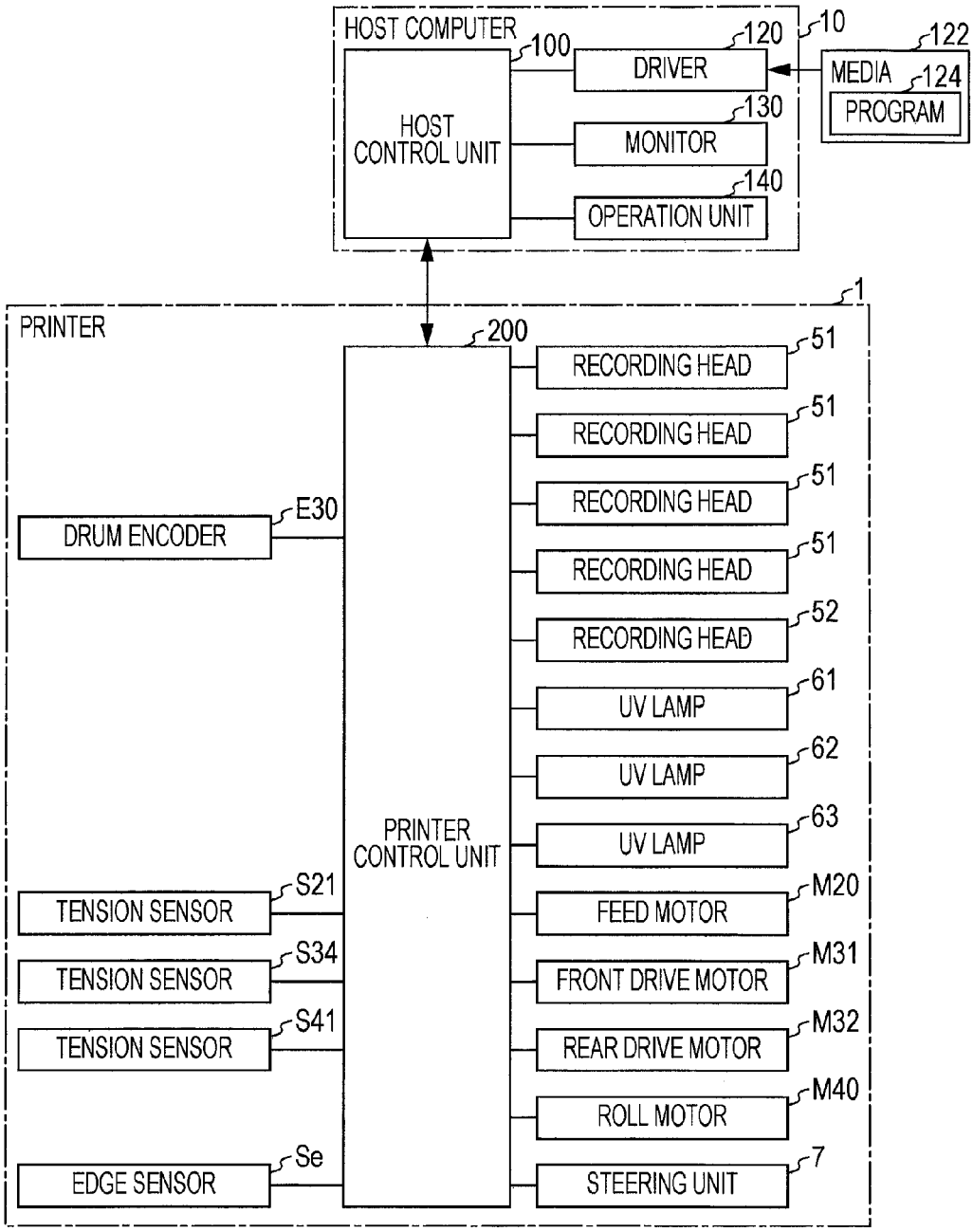
FIG. 2 is a schematic diagram illustrating an electrical configuration which controls the printer in FIG. 1.

The above is a summary of the apparatus configuration of the printer 1. Subsequently, an electrical configuration to control the printer 1 will be described. FIG. 2 is a schematic block diagram illustrating an electrical configuration which controls the printer 1 in FIG. 1. The above-described operation of the printer 1 is controlled by a host computer 10 illustrated in FIG. 2. In the host computer 10, a host control unit 100 that administrates the control operations is configured to include a CPU (Central Processing Unit) and memories. In addition, a driver 120 is provided in the host computer 10. The driver 120 reads a program 124 from media 122. Moreover, as media 122, a variety of devices can be used such as a CD (Compact Disk), DVD (Digital Versatile Disk), and USB (Universal Serial Bus) memory. Then, the host control unit 100 performs the control of each part of the host computer 10 and the operation control of the printer 1, based on the program 124 read from the media 122.

Furthermore, in the host computer 10, as an interface with the users, a monitor 130 configured with a liquid crystal display and an operation unit 140 configured with a keyboard or a mouse, are provided. In the monitor 130, a menu screen is displayed in addition to the image to be printed. Accordingly, by operating the operation unit 140 while checking the monitor 130, it is possible for the user to open the print setting screen from the menu screen, and to set various printing conditions such as type of recording medium, size of the recording medium and quality of printing. Moreover, various modifications may be used for the specific configuration for the interface with the user. For example, a touch panel display may be used as a monitor 130 and the touch panel in the monitor 130 may be also used for the configuration of the operation unit 140.

On the other hand, in the printer 1, a printer control unit 200 is provided which controls each part of the printer 1 according to the instructions from the host computer 10. Then, the recording heads, UV lamps and each part of the apparatus in the sheet transportation system are controlled by the printer control unit 200. The controlling by the printer control unit 200 to each part of the apparatus will be specifically described below.

The printer control unit 200 controls an ink ejection timing of each recording head 51 which forms the color image in accordance with the transportation of the sheet S. Specifically, the control of the ink ejection timing is performed based on an output (a detected value) of a drum encoder E30 which is mounted on the rotation shaft of the platen drum 30 and detects a rotation position of the platen drum 30. That is, since the platen drum 30 is driven to rotate along with the transportation of the sheet S, the transportation position of the sheet S can be recognized by referring to the output of the drum encoder E30 which detects the position of the platen drum 30. Here, the printer control unit 200 generates a pts (print timing signal) signal from the output of the drum encoder E30 and lands the ink ejected by each recording head 51 on the target position of the transported sheet S by controlling the ink ejection timing of each recording head 51 based on the pts signal, and forms the color image.

In addition, the timing in which the recording head 52 ejects the transparent ink also similarly controlled by the printer control unit 200 based on the output of the drum encoder E30. In this way, the transparent ink can be correctly ejected with respect to the color image formed by the plurality of recording heads 51. Furthermore, a timing of switching on and off, and a light irradiation intensity of the UV lamps 61, 62 and 63 are also controlled by the printer control unit 200.

In addition, the printer control unit 200, administrates the function of controlling the transportation of the sheet S described above using FIG. 1. That is, motors are connected to the feeding shaft 20, the front drive roller 31, the rear drive roller 32 and the roll shaft 40 each respectively, among the members which configure the sheet transportation system. Then, the printer control unit 200 rotates the motors and controls the speeds or the torques of the motors to control the transportation of the sheet S. The transportation control for the sheet S will be specifically described below.

The printer control unit 200 rotates a feed motor M20 which drives the feeding shaft 20 to feed the sheet S from the feeding shaft 20 to the front drive roller 31. On this occasion, the printer control unit 200 controls the torque of the feed motor M20 to adjust the tension of the sheet S from the feeding shaft 20 to the front drive roller 31 (feed tension Ta). That is, a tension sensor S21 which detects the feed tension Ta is mounted on the driven roller 21 disposed between the feeding shaft 20 and the front drive roller 31. The tension sensor S21, for example, can be configured to include a load cell which detects a force received from the sheet S. Then, the printer control unit 200, based on the detection result by the tension sensor S21, feedback-controls the torque of the feed motor M20 to adjust the feed tension Ta of the sheet S.

In this case, the printer control unit 200 adjusts a position of the sheet S fed from the feeding shaft 20 to the front drive motor 31, in width direction (a direction perpendicular to the surface of the paper in FIG. 1), and performs the feeding of the sheet S. That is, in the printer 1, there are provided steering units 7 which displace the feeding shaft 20 and the driven roller 21 respectively in a shaft direction (in other words, the width direction of the sheet S). In addition, between the driven roller 21 and the front drive roller 31, an edge sensor Se is disposed which detects the edge of the sheet S in the width direction. The edge sensor Se, for example, can be configured to include a distance sensor such as an ultrasonic sensor. Then, the printer control unit 200 feedback-controls, based on the detection result of the edge sensor Se, the steering unit 7 to adjust the position of the sheet S in width direction. As a result, the position of the sheet S in the width direction comes into the proper position and a transportation defect such as a meandering of the sheet S can be suppressed.

In addition, the printer control unit 200 rotates the front drive motor M31 which drives the front drive roller 31 and the rear drive motor M32 which drives the rear drive roller 32. As a result, the sheet S fed from the feed unit 2 passes through the process unit 3. At this time, a speed control with respect to the front drive motor M31 is performed while the torque control with respect to the rear drive motor M32 is performed. That is, the printer control unit 200 adjusts the rotation speed of the front drive motor M31 to be constant, based on the encoder output of the front drive motor M31. As a result, the sheet S is transported at a constant speed by the front drive roller 31.

On the other hand, the printer control unit 200 controls the torque of the rear drive motor M32 to adjust the tension of the sheet S from the front drive roller 31 to the rear drive roller 32 (a process tension Tb). That is, on the driven roller 34 disposed between the platen drum 30 and the rear drive roller 32, a tension sensor S34 which detects a process tension Tb is mounted. The tension sensor S34, for example, can be configured to include a load cell which detects a force received from the sheet S. Then, the printer control unit 200, based on the detection result by the tension sensor S34, feedback-controls the torque of the rear drive motor M32 to adjust the process tension Tb of the sheet S.

In addition, the printer control unit 200 rotates the feed motor M40 which drives the feeding shaft 40 to roll the sheet S transported by the rear drive roller 32 to the roll shaft 40. On this occasion, the printer control unit 200 controls the torque of the roll motor M40 to adjust a tension of the sheet S from the rear drive roller 32 to the roll shaft 40 (a roll tension Tc). That is, on the driven roller 41 disposed between the rear drive roller 32 and the roll shaft 40, a tension sensor S41 which detects a roll tension Tc is mounted. The tension sensor S41, for example, can be configured to include a load cell which detects a force received from the sheet S. Then, the printer control unit 200, based on the detection result by the tension sensor S41, feedback-controls the torque of the roll motor M40 to adjust the roll tension Tc of the sheet S.

Described above is a summary of the electrical configuration for controlling the printer 1. As described above, the front drive roller 31 rotates in a predetermined speed, and thereby the sheet S is transported in a constant speed along the transportation path Pc. Then, the printer control unit 200 controls the transportation speed of the sheet S to be constant and performs the adjustment of the tension Ta, Tb and Tc applied to the sheet S. With regard to the tension control to the tension of each region Ta, Tb and Tc, further description will be made using the FIGS. 1 and 2.

The adjustment of the feed tension Ta is performed by adjusting the torque of the feeding shaft 20. Specifically, while a force F20 is acting on the sheet S in a reverse direction with respect to a direction in which the sheet S is pulled out from the feeding shaft 20 to the front drive roller 31 (the transportation direction), the feeding shaft 20 rotates clockwise in FIG. 1. At this time, in between output torque tm20 of the feed motor M20 and the radius Ra of the roll formed by the sheet S wound to the feeding shaft 20, the force F20 has a relationship, F20=tm20/Ra. Accordingly, with the feedback-control of the output torque tm20 of the feed motor M20 based on the value of the feed tension Ta detected by the tension sensor S21, the feed tension Ta can be adjusted by adjusting the force F20 acting on the sheet S.

Moreover, since the rotation speed of the front drive roller 31 is adjusted to be constant, the force acting on the sheet S on the down-stream of the transportation path Pc compared to the front drive roller 31 does not influence the feed tension Ta. Accordingly, the feed tension Ta has an equal value to the force F20. That is, the following equation is satisfied.

$$Ta=F20=tm20/Ra \qquad \text{Equation 1}$$

The adjustment of the process tension Tb is performed by adjusting the torque of the rear drive roller 32. Specifically, while a force F32 is acting on the sheet S in a transportation direction of the sheet S, the rear drive roller 32 rotates clockwise in FIG. 1. At this time, in between the output torque tm32 of the rear drive motor M32 and the radius Rb of the rear drive roller 32, the force F32 has a relationship, F32=tm32/Rb. Accordingly, with the feedback-control of the output torque tm32 of the rear drive motor M32 based on the value of the process tension Tb detected by the tension sensor S34, the process tension Tb can be adjusted by adjusting the force F32 acting on the sheet S.

Furthermore, since the rotation speed of the front drive roller 31 is adjusted to be constant, the force acting on the sheet S on the up-stream of the transportation path Pc compared to the front drive roller 31 does not influence the process tension Tb. However, as described below, in the down-stream of the transportation path Pc compared to the rear drive roller 32, the roll shaft 40 acts the force F40 on the sheet S and the force F40 influences the process tension Tb. Specifically, the process tension Tb is a value obtained by combining the force F32 and the force F40. That is, the following equation is satisfied.

$$Tb=F32+F40=tm32/Rb+F40 \quad \text{Equation 2}$$

The adjustment of the roll tension Tc is performed by adjusting the torque of the roll shaft 40. Specifically, while a force F40 is acting on the sheet S in a transportation direction of the sheet S, the roll shaft 40 rotates clockwise in FIG. 1. At this time, in between output torque tm40 of the roll motor M40 and the radius Rc of the roll formed by the sheet S wound to the roll shaft 40, the force F40 has a relationship, F40=tm40/Rc. Accordingly, with the feedback-control of the output torque tm40 of the roll motor M40 based on the value of the roll tension Tc detected by the tension sensor S41, the roll tension Tc can be adjusted by adjusting the force F40 acting on the sheet S. Accordingly, the roll tension Tc has an equal value to the force F40. That is, the following equation is satisfied.

$$Tc=F40=tm40/Rc \quad \text{Equation 3}$$

Incidentally, in the printer 1 described above, in order to properly record the image on the sheet S, it is important to stabilize the process tension Tb in the process unit 3 where the image recording is performed. Accordingly, it is required to stabilize the process tension Tb by suppressing the influence of a disturbance to the process tension Tb. However, as is understandable by the above-described equations 2 and 3, the tension Tb of the process unit 3 is correlated with the tension Tc of the roll unit 4 which is interposed by and adjacent to the rear drive roller 32 on which the torque control is performed (Tb=F32+Tc). Therefore, it is considered that the influence of the disturbance generated in the roll unit 4 may be absorbed by the process tension Tb.

Especially, in the roll unit 4, a periodic fluctuation component with a comparatively high speed (a rotation period pr of the roll shaft 40) caused by the rotation of the roll shaft 40 is likely to be generated in the roll tension Tc. As an example of a reason for the generation of the periodic fluctuation component, the mounted state of the core tube 42 on the roll shaft 40 is considered. Specifically, the periodic fluctuation component is generated in the roll tension Tc due to the mounted state where the core tube 42 is deformed by a stress acting between the roll shaft 40 and the core tube 42, or a center shaft of the core tube 42 and the roll shaft 40 is deviated, or the core tube 42 is inclined with respect to the roll shaft 40. Then, the periodic fluctuation component is transmitted to the sheet S in the process region and disturbs the tension control of the sheet S in the process unit 3. Thus, there is a possibility that the process tension Tb vibrates and becomes unstable (in other words, oscillates). Therefore, in the embodiment, the frequency response characteristics of the tension control with respect to the process unit 3 and the roll unit 4 is set as described below.

Figure 3:
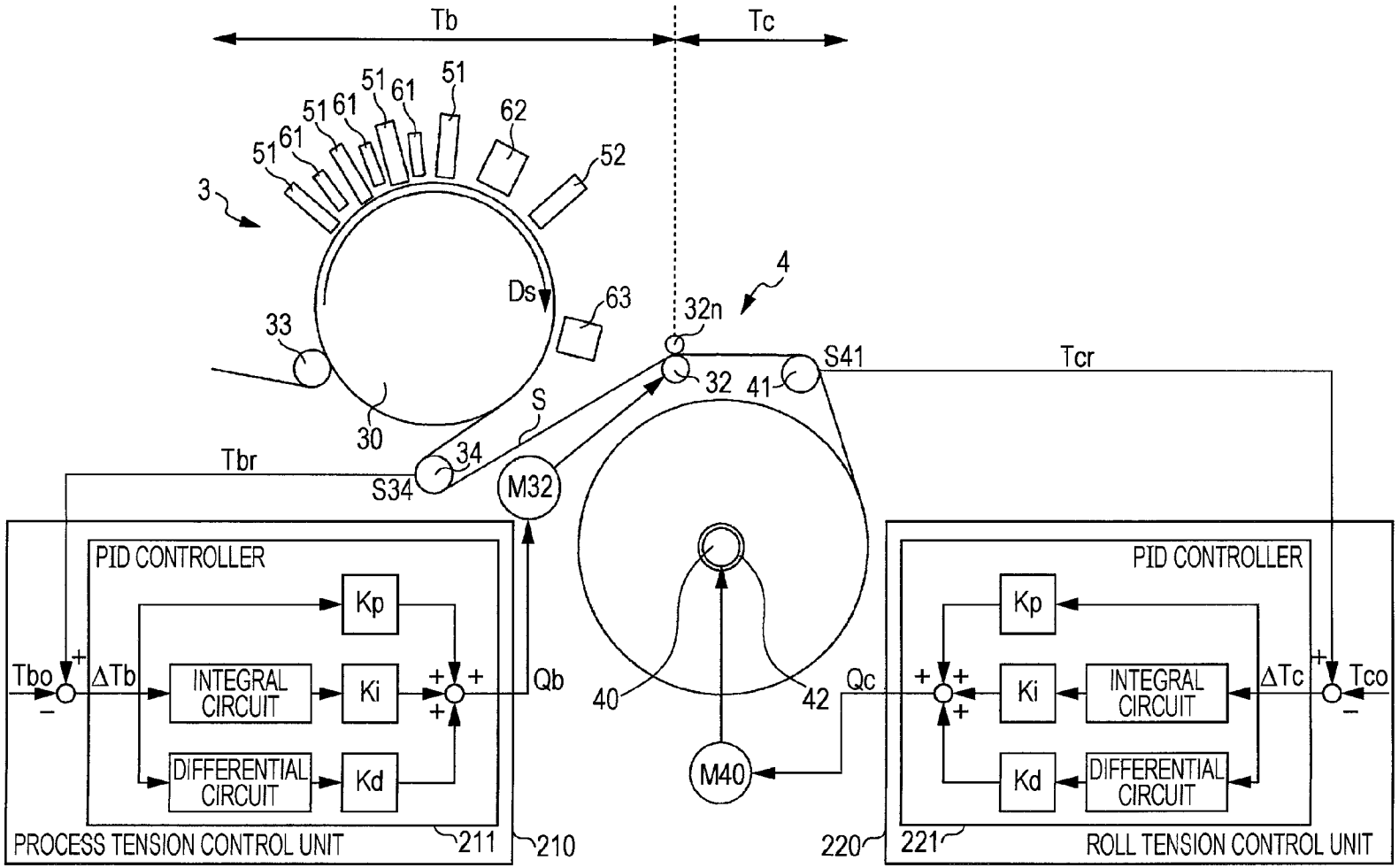
FIG. 3 is a diagram illustrating a configuration of a first embodiment which performs a controlling of a sheet tension.

FIG. 3 is a diagram schematically illustrating a configuration of the first embodiment in which the tension control of the sheet with respect to the process unit and the roll unit is performed. As illustrated in FIG. 3, a process tension control unit 210 is provided with respect to the tension control in the process unit 3, and a roll tension control unit 220 is provided with respect to the tension control in the roll unit 4. Moreover, the tension control units 210 and 220 are built in the printer control unit 200 (FIG. 2).

The process tension control unit 210 seeks a difference ΔTb (=Tbr−Tbo) between a value Tbr of the process tension Tb detected by the tension tensor S34 and a target value Tbo of the process tension Tb. In addition, the PID controller 211 in the process tension control unit 210 performs a PID (Proportional Integral Differential) control based on the difference ΔTb. That is, the PID controller 211 generates a motor control signal Qb by adding; a value obtained by multiplying ΔTb by a proportional gain Kp, a value obtained by time integrating ΔTb with integral circuit and multiplying an integral gain Ki and a value obtained by time differentiating ΔTb and multiplying a differential gain Kd. Then, the process tension Tb is controlled by applying the torque corresponding to the motor control signal Qb, by the rear drive motor M32, to the rear drive roller 32. In this way, the process tension control unit 210 feedbacks the detected value of the process tension Tb to the torque of the rear drive motor M32 which controls the process tension Tb to control the process tension Tb.

The roll tension control unit 220 seeks for a difference ΔTc between a value Tcr of the roll tension Tc detected by the tension tensor S41 and a target value Tco of the roll tension Tc. In addition, the PID controller 221 in the roll tension control unit 220 performs a PID control based on the difference ΔTc and generates a motor control signal Qc. Then, the roll tension Tc is controlled by applying the torque corresponding to the motor control signal Qc, by the roll motor M40, to the roll shaft 40. In this way, the roll tension control unit 220 feedbacks the detected value of the roll tension Tc to the torque of the roll shaft 40 which controls the roll tension Tc to control the roll tension Tc.

Figures 4, 5:
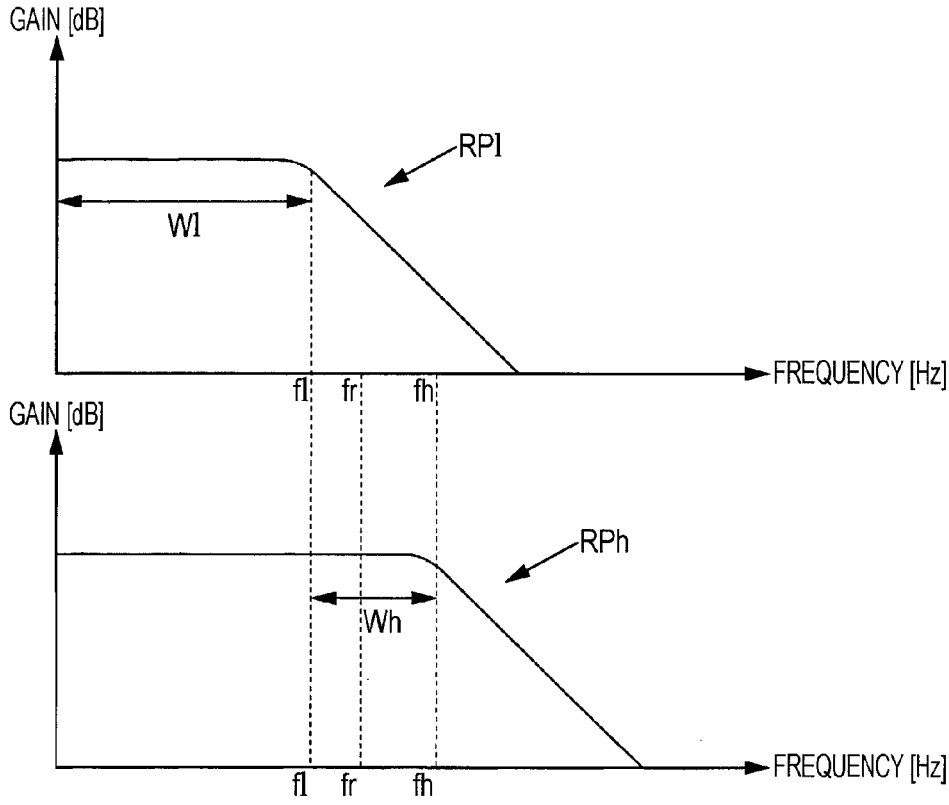
FIG. 4 is a diagram in which set values of PID control gains are illustrated as table.
FIG. 5 is a diagram illustrating Bode plots showing frequency response characteristics of a tension control unit.

Then, in the embodiment, by setting the gains Kp, Ki and Kd of the PID controllers 211 and 221, the frequency response characteristics of each of the tension control units 210 and 220 is adjusted. (FIG. 4) Here, FIG. 4 is a diagram illustrating the set values of gain for the PID controls as a table. Any one of each value Bi, Cp and Ci shown in FIG. 4 is a finite value other than zero.

As illustrated in FIG. 4, in the PID controller 211 of the process unit 3, both of the proportional gain Kp and differential gain Kd are set to zero and only the integral gain Ki is set to a positive value Bi (=2). Accordingly, the process tension control unit 210 performs the integral operation only among the integral operation, the proportional operation and the differential operation, with respect to the detected value of the process tension Tb, and controls the process tension Tb. Therefore, the process tension control unit 210 shows frequency response characteristics having a low band width and does not respond for a steep tension variation.

On the other hand, in PID controller 221 of the roll unit 4, the differential gain Kd is set to zero while the proportional gain Kp and the integral gain Ki are set to positive values respectively. Specifically, the proportional gain Kp is set to a value Cp (=10) and the integral gain Ki is set to a value Ci (=40>Bi). The proportional gain Kp is set to a positive value Cp like this, the roll tension control unit 220 performs the proportional operation in addition to the integral operation with respect to the detected value of the roll tension Tc, and controls the roll tension Tc. Therefore, the roll tension control unit 220 shows frequency response characteristics having a high band and respond to a steep tension variation also.

As a result of setting in this way, in the embodiment, compared to the frequency response characteristics of the process tension control unit 210 with respect to the tension fluctuations generated in the process unit 3, the frequency response characteristics of the roll tension control unit 220 with respect to the tension fluctuations generated in the roll unit 4 respond to the tension fluctuations having a higher frequency band. With regard to the frequency response characteristics of the tension control unit 210 and 220 like this will be described using FIG. 5.

FIG. 5 is a diagram illustrating Bode plots showing frequency response characteristics of a tension control unit. In the diagram, the frequency response characteristics of the process tension control unit 210 is illustrated in the upper part and the frequency response characteristics of the roll tension control unit 220 is illustrated in the lower part. As illustrated in the diagram, a cutoff frequency fl of the frequency response characteristics RPl of the process tension control unit 210 is lower than a cutoff frequency fh of the frequency response characteristics RPh of the roll tension control unit 220 (fl<fh). Therefore, the frequency response characteristics RPh of the process tension control unit 210 respond with respect to the tension fluctuations in a low band Wl with a cutoff frequency lower than fl, but do not respond with respect to the tension fluctuations in a high band Wh with a cutoff frequency from fl to fh. On the other hand, the frequency response characteristics RPh of the roll tension control unit 220 respond with respect to the tension fluctuations in any of the low band Wl and the high band Wh.

In addition, the high band Wh is set so as to include a frequency fr (=1/pr) of the periodic fluctuation component caused by the rotation of the roll shaft 40 described above. Therefore, the roll tension control unit 220 responds to the periodic fluctuation component with the frequency fr generated in the roll tension Tc and controls the roll tension Tc. On the other hand, the process tension control unit 210, even though the periodic fluctuation component with the frequency fr in the process tension Tb, does not respond thereto.

As described above, in the embodiment, the torque of the rear drive roller 32 is adjusted based on the detection result of the tension Tb of the sheet S in the process unit 3 where the image recording is performed on the sheet S, and the tension Tb of the sheet S in the process unit 3 is controlled. In addition, the tension Tc of the sheet S in the roll unit 4 is adjusted according to the detection result of the tension Tc of the sheet S in the roll unit 4 which is on the opposite side to the process unit 3 with respect to the rear drive roller 32. That is, in each of the process unit 3 and the roll unit 4 which interpose the rear drive roller 32, the tension control of the sheet S is performed according to the detection result of the tension of the sheet S.

Then, in the embodiment, the apparatus is configured such that; compared to the frequency response characteristics RPl of the tension control with respect to the process unit 3, the frequency response characteristics RPh of the tension control with respect to the roll unit 4 respond to the tension fluctuations having higher frequency band Wh. As a result, the tension control can be performed in such a manner that, the tension control with respect to the slow frequency response characteristics in the process unit 3 does not respond to the tension fluctuations with high frequency, and only the tension control with the fast response characteristics with respect to the roll unit 4 respond to the tension fluctuations with high frequency. Accordingly, even though the tension fluctuations with high frequency generated in the roll unit 4 is transmitted to the process unit 3, the disturbance of the tension control by this tension fluctuations with respect to the process unit 3 can be suppressed, and as a result, a situation can be suppressed in which a vibration of the tension Tb of the sheet S in the process unit 3 is generated. In this way, in the process unit 3 where the image recording on the sheet S is performed, the tension Tb of the sheet S is stabilized. Thus a proper image recording can be performed.

In the embodiment, the invention is applied to the printer 1 having the periodic fluctuation component in which the tension Tc of the sheet S in the roll unit 4 fluctuates periodically. In this way, an influence of the periodic fluctuation component generated in the tension Tc of the sheet S in the roll unit 4 is suppressed and the tension Tb of the sheet S in the process unit 3 is stabilized. Thus, a proper image recording can be performed.

Particularly, the apparatus is configured such that; the frequency response characteristics RPl of the process tension control unit 210 do not respond to the tension fluctuations of the periodic fluctuation component with the frequency fr. Therefore, even though the periodic fluctuation component generated in the tension Tc of the sheet S in the roll unit 4 is transmitted to the sheet S in the process unit 3, the tension control with respect to the process unit 3 does not respond to the periodic fluctuation component. Accordingly, since the periodic fluctuation component disturbs the tension control with respect to the process unit 3, a situation can be effectively suppressed in which a vibration of the tension of the sheet S in the process unit 3 is generated.

In addition, the frequency response characteristics RPh of the roll tension control unit 220 respond to the tension fluctuations of the periodic fluctuation component with the frequency fr. Therefore, the periodic fluctuation component generated in the tension Tc of the sheet S in the roll unit 4 can be properly suppressed using the tension control with respect to the roll unit 4. Thus, the tension control of the sheet S in the roll unit 4 can be stabilized.

In addition, in the embodiment, the platen drum 30 is provided which comes in contact with the sheet S on which the image is recorded by the recording head 51 in the process unit 3 and rotates by being driven by the transported sheet S. In this way, the sheet S is supported in the process unit 3 by the platen drum 30 being driven to rotate by the transported sheet S. Thus, the tension Tb of the sheet S in the process unit 3 can be stabilized.

Second Embodiment

In the first embodiment described above, the torque control with respect to the rear drive motor M32 is performed while the speed control with respect to the front drive motor M31 is performed. On the contrary, in the second embodiment the speed control with respect to the rear drive motor M32 is performed while the torque control with respect to the front drive motor M31 is performed. Since the major difference between the second embodiment and the first embodiment is the relationship between speed and torque control for the drive motors M31 and M32, hereinafter, the description will be mainly focused on the differences and the description for the common parts will be omitted with the same reference numbers. In addition, since the configuration in the second embodiment is common to the first embodiment, it is needless to say that similar effect may be achieved.

In the second embodiment as described above, a torque control is performed with respect to the front drive roller 31. Accordingly, the tension Tb in the process unit 3 has a relationship with the tension Ta of the feed unit 2 adjacent to each other with interposing the front drive roller 31 on which the torque control is performed. Therefore, it is considered that the process tension Tb is influenced by a disturbance generated in the feed unit 2. Particularly, since the feed unit 2 has a configuration in which the core tube 22 is mounted on the feeding shaft 20, due to the similar reason in the roll shaft 40 described above, the periodic fluctuation component with a comparatively high period (the rotation period pr of the feeding shaft 20) caused by the rotation of the feeding shaft 20 is likely to be generated in the feed tension Ta. Then, the periodic fluctuation component is transmitted to the sheet S in the process unit 3 and disturbs the tension control of the sheet S in the process unit 3. Thus, there is a possibility that the process tension Tb vibrates and becomes unstable (in other words, oscillates). Therefore, in the embodiment, the frequency response characteristics of the tension control with respect to the process unit 3 and the feed unit 2 is set as described below.

Figure 6:
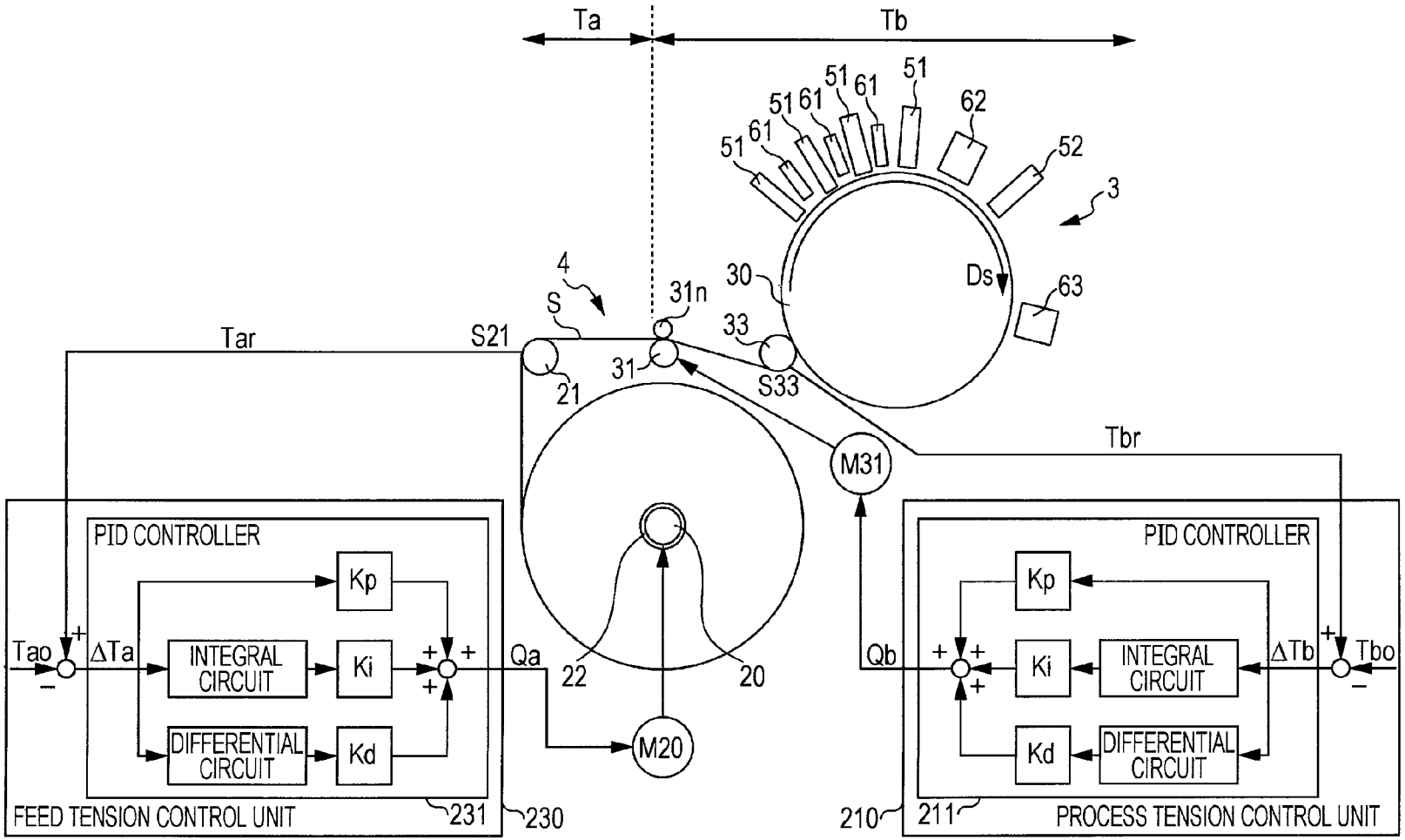
FIG. 6 is a diagram illustrating a configuration of a second embodiment which performs a controlling of a sheet tension.

FIG. 6 is a diagram schematically illustrating a configuration of the second embodiment which performs the controlling of the sheet tension with respect to the process unit and the feed unit. As illustrated in FIG. 6, the process tension control unit 210 is provided with respect to the tension control in the process unit 3, and a feed tension control unit 230 is provided with respect to the tension control in the feed unit 2. Moreover, the tension control units 210 and 230 are built in the printer control unit 200 (FIG. 2).

In the embodiment, the tension sensor S33 configured to include a load cell is mounted on the driven roller 33, and the process tension Tb is detected by the tension sensor S33. Then, the process tension control unit 210 seeks a difference ΔTb (=Tbr−Tbo) between a value Tbr of the process tension Tb detected by the tension tensor S33 and a target value Tbo of the process tension Tb. In addition, the PID controller 211 in the process tension control unit 210 performs a PID control similar to that in the first embodiment based on the difference ΔTb to generate a motor control signal Qb. Then, the process tension Tb is controlled by applying the torque corresponding to the motor control signal Qb, by the front drive motor M31, to the front drive roller 31. In this way, the process tension control unit 210 feedbacks the detected value of the process tension Tb to the torque of the front drive motor M31 which controls the process tension Tb and controls the process tension Tb.

The feed tension control unit 230 seeks a difference ΔTa between a value Tar of the feed tension Ta detected by the tension tensor S21 and a target value Tao of the feed tension Ta. In addition, the PID controller 231 in the feed tension control unit 230 performs a PID control based on the difference ΔTa and generates a motor control signal Qa. Then, the feed tension Ta is controlled by applying the torque corresponding to the motor control signal Qa, by the feed motor M20, to the feeding shaft 20. In this way, the feed tension control unit 230 feedbacks the detected value of the feed tension Ta to the torque of the feeding shaft 20 which controls the feed tension Ta and controls the feed tension Ta.

Then, in the embodiment, by setting the gains Kp, Ki and Kd of the PID controllers 211 and 231, the frequency response characteristics of the each tension control units 210 and 230 is adjusted. Specifically, the set values of gain Kp, Ki ns Kd in the PID controller 211 in the process unit 3 are same as those in the first embodiment. In addition, the set values of gain Kp, Ki and Kd in the PID controller 231 in the feed unit 2 are same as gain Kp, Ki and Kd in the PID controller 221 in the first embodiment. As a result of setting in this way, the frequency response characteristics of the process tension control unit 210 is similar to that in the first embodiment, and the frequency response characteristics of the feed tension control unit 230 is similar to the frequency response characteristics of the roll tension control unit 220 in the first embodiment.

Therefore, in the embodiment, compared to the frequency response characteristics of the process tension control unit 210 with respect to the tension fluctuations generated in the process unit 3, the frequency response characteristics of the feed tension control unit 230 with respect to the tension fluctuations generated in the feed unit 2 respond to the tension fluctuations having a higher frequency band. In addition, the frequency response characteristics of the tension control units 210 and 230 in the second embodiment may be described as below using FIG. 5. That is, a cutoff frequency fl of the frequency response characteristics RPl of the process tension control unit 210 is lower than a cutoff frequency fh of the frequency response characteristics RPh of the feed tension control unit 230 (fl<fh). Therefore, the frequency response characteristics RPl of the process tension control unit 210 respond with respect to the tension fluctuations in a low band Wl with a cutoff frequency lower than fl, but do not respond with respect to the tension fluctuations in a high band Wh with a cutoff frequency from fl to fh. On the other hand, the frequency response characteristics RPh of the feed tension control unit 230 respond with respect to the tension fluctuations in any of the low band Wl and the high band Wh.

In addition, the high band Wh is set so as to include a frequency fr (=1/pr) of the periodic fluctuation component caused by the rotation of the feeding shaft 20 as described above. Therefore, the feed tension control unit 230 responds to the periodic fluctuation component with the frequency fr generated in the feed tension Ta and controls the feed tension Ta. On the other hand, the process tension control unit 210, even though the periodic fluctuation component with the frequency fr in the process tension Tb, does not respond thereto.

As described above, in the embodiment, the torque of the front drive roller 31 is adjusted based on the detection result of the tension Tb of the sheet S in the process unit 3 where the image recording is performed on the sheet S, and the tension Tb of the sheet S in the process unit 3 is controlled. In addition, the tension Ta of the sheet S in the feed unit 2 is adjusted according to the detection result of the tension Ta of the sheet S in the feed unit 2 which is on the opposite side to the process unit 3 with respect to the front drive roller 31. That is, in each of the process unit 3 and the feed unit 2 which interposes the front drive roller 31, the tension control of the sheet S is performed according to the detection result of the tension of the sheet S.

Then, in the embodiment, the apparatus is configured such that; compared to the frequency response characteristics RPl of the tension control with respect to the process unit 3, the frequency response characteristics RPh of the tension control with respect to the feed unit 2 respond to the tension fluctuations having higher frequency band Wh. As a result, the tension control can be performed in such a manner that, the tension control with respect to the slow frequency response characteristics in the process unit 3 does not respond to the tension fluctuations with high frequency, and only the tension control with the fast response characteristics with respect to the feed unit 2 respond to the tension fluctuations with high frequency. Accordingly, even though the tension fluctuations with high frequency generated in the feed unit 2 is transmitted to the process unit 3, the disturbance of the tension control by this tension fluctuations with respect to the process unit 3 can be suppressed, and as a result, a situation can be suppressed in which a vibration of the tension Tb of the sheet S in the process unit 3 is generated. In this way, in the process unit 3 where the image recording on the sheet S is performed, the tension Tb of the sheet S is stabilized. Thus a proper image recording can be performed.

In the embodiment, the invention is applied to the printer 1 having the periodic fluctuation component in which the tension Ta of the sheet S in the feed unit 2 fluctuates periodically. In this way, an influence of the periodic fluctuation component generated in the tension Ta of the sheet S in the feed unit 2 is suppressed and the tension Tb of the sheet S in the process unit 3 is stabilized. Thus, a proper image recording can be performed.

Particularly, the apparatus is configured such that; the frequency response characteristics RPl of the process tension control unit 210 do not respond to the tension fluctuations of the periodic fluctuation component with the frequency fr. Therefore, even though the periodic fluctuation component generated in the tension Ta of the sheet S in the feed unit 2 is transmitted to the sheet S in the process unit 3, the tension control with respect to the process unit 3 does not respond to the periodic fluctuation component. Accordingly, since the periodic fluctuation component disturbs the tension control with respect to the process unit 3, a situation can be effectively suppressed in which a vibration of the tension of the sheet S in the process unit 3 is generated.

In addition, the frequency response characteristics RPh of the feed tension control unit 230 respond to the tension fluctuations of the periodic fluctuation component with the frequency fr. Therefore, the periodic fluctuation component generated in the tension Ta of the sheet S in the feed unit 2 can be properly suppressed using the tension control with respect to the feed unit 2. Thus, the tension control of the sheet S in the feed unit 2 can be stabilized.

Others

As described above, in the embodiments, the printer 1 corresponds to the "image recording apparatus" in the invention, the host computer 10 corresponds to the "computer" in the invention, the program 124 corresponds to the "program" in the invention, the media 122 corresponds to the "program recording medium" in the invention, the sheet S corresponds to the "recording medium" in the invention and the platen drum 30 corresponds to the "driven rotary member" in the invention. In addition, in the first embodiment described above, the process unit 3 corresponds to the "first region" in the invention, the rear drive roller 32 corresponds to the "drive roller" in the invention, the process tension control unit 210 and the tension sensor S34 cooperate and function as the "first control unit" in the invention, the roll unit 4 corresponds to the "second region" in the invention, the roll tension control unit 220 and the tension sensor S41 cooperate and function as the "second control unit" in the invention. In addition, in the second embodiment, the process unit 3 corresponds to the "first region" in the invention, the front drive roller 31 corresponds to the "drive roller" in the invention, the process tension control unit 210 and the tension sensor S33 cooperate and function as the "first control unit" in the invention, the feed unit 2 corresponds to the "second region" in the invention, and the feed tension control unit 230 and the tension sensor 21 cooperate and function as the "second control unit" in the invention.

Furthermore, the invention is not limited to the embodiments described above and various modifications with respect to the above description may be added within the scope of the invention. For example, in the embodiment described above, the periodic fluctuation component generated in the roll unit 4 and the feed unit 2 is assumed as a disturbance transmitted to the process unit 3 with interposing the drive rollers 31 and 32 of which the torque is controlled. However, a disturbance other than this may be assumed. For example, the tension control of the sheet S may be performed so that the frequency of the disturbance is included in the above-described high band W. On this occasion, in a case where the influence of the periodic fluctuation component generated in the roll unit 4 and the feed unit 2 is small, the tension control of the sheet S may be performed so that the frequency of the periodic fluctuation component deviates from the high band W.

In addition, each of the gains Kp, Ki and Kd set to each of the PID controllers 211, 221 and 231 for PID control may be appropriately changed. For example, with respect to the PID controllers 221 and 231 in the roll tension control unit 220 or the feed tension control unit 230, a positive differential gain Kd or a proportional gain Kp of zero may be set.

Incidentally, in the embodiments described above, the apparatus has a configuration in which, compared to the frequency response characteristics RPl of the tension control in the process unit 3, the frequency response characteristics RPh of the tension control in the roll unit 4 and the feed unit 2 respond to the tension fluctuations having a higher frequency band. Then, as a specific mechanism to realize such a configuration, various embodiments may be adopted, not limited to those described above.

In addition, the process tension control unit 210 may be configured to include a low pass filter which passes only a frequency band having a frequency equal to or lower than the predetermined frequency (for example, the frequency fl described above) to a feedback loop which feedbacks the detection results of the tension fluctuations to the torque of the drive rollers 31 and 32. Alternatively, the process tension control unit 210 may be configured so that the tension sensors S33 and S34 do not detect the tension fluctuations having a higher frequency band than the predetermined frequency (for example, the frequency fl described above). Also by this configuration, the frequency band of the frequency response characteristics RPl of the process unit 3 can be set low in a similar manner as described above.

What is claimed is:

1. An image recording apparatus comprising:

a recording unit that records an image on a the recording medium in a first region;

a drive roller that transports the recording medium, the drive roller being disposed between the first region and a second region;

a first control unit that controls a tension of the recording medium in the first region by adjusting a torque of the drive roller based on a detection result of the tension of the recording medium in the first region, the first control unit having frequency response characteristics with respect to tension fluctuations generated in the first region; and a second control unit that controls the tension of the recording medium in the second region according to a detection result of the tension of the recording medium in the second region, the second control unit having frequency response characteristics with respect to tension fluctuations generated in the second region for responding to the tension fluctuations having a higher frequency band compared to the tension fluctuation characteristics of the first control unit.

2. The image recording apparatus according to claim 1, wherein the tension of the recording medium in the second region has a periodic fluctuation component in which the tension fluctuates periodically.

3. The image recording apparatus according to claim 2, wherein the frequency response characteristics of the first control unit do not respond with respect to the tension fluctuations with the frequency of the periodic fluctuation component.

4. The image recording apparatus according to claim 2, wherein the frequency response characteristics of the second control unit respond with respect to the tension fluctuations with the frequency of the periodic fluctuation component.

5. The image recording apparatus according to claim 2, wherein the drive roller transports the recording medium from the first region to the second region, wherein the apparatus further comprises a roll shaft that rotates and rolls the recording medium in the second region, and wherein the tension of the recording medium in the second region has a periodic fluctuation component in which the tension fluctuates in a rotation period of the roll shaft.

6. The image recording apparatus according to claim 2, wherein the drive roller transports the recording medium from the second region to the first region, wherein the apparatus further comprises a feeding shaft that rotates and feeds the recording medium in the second region, and wherein the tension of the recording medium in the second region has a periodic fluctuation component in which the tension fluctuates in a rotation period of the feeding shaft.

7. The image recording apparatus according to claim 1, further comprising:

a driven rotary member which comes in contact with the recording medium on which the image is formed on the recording unit in the first region and rotates by being driven by the transported recording medium.

8. The image recording apparatus according to claim 7, wherein the first control unit detects the tension of the recording medium, between the driven rotary member and the drive roller.

9. The image recording apparatus according to claim 1, wherein the first control unit controls the tension of the recording medium in the first region by performing only an integral action among the integral action, a proportional action and a differential action, with respect to the detection result of the tension fluctuations of the recording medium, and wherein the second control unit controls the tension of the recording medium in the second region by performing other than the integral action with respect to the detection result of the tension fluctuations of the recording medium.

10. The image recording apparatus according to claim 1, wherein the first control unit includes a filter that transfers only a frequency band with the frequency equal to or less than the predetermined value, to a feedback loop which returns the detection result of the tension fluctuations of the recording medium to the torque of the drive roller.

11. An image recording method in which an image is recorded on a recording medium, the method comprising:

first controlling a tension of the recording medium in a first region by adjusting a torque of the drive roller which transports the recording medium based on a detection result of a tension of the recording medium in a first region where an image recording is performed on the recording medium;

second controlling the tension of the recording medium in a second region according to the detection result of the tension of the recording medium in a second region which is in an opposite side interposing the recording unit with respect to the drive roller;

wherein, compared to the frequency response characteristics represented by the tension control in the first controlling with respect to the tension fluctuations generated in the first region, the frequency response characteristics represented by the tension control in the second controlling with respect to the tension fluctuations generated in the second region respond to the tension fluctuations having a higher frequency band.

12. A non-transitory computer readable medium in which a program is recorded and executable by a computer, the program being used for the computer that controls an image recording apparatus which records an image on a recording medium, the program causing the computer to function as:

a first control unit that controls a tension of the recording medium in a first region by adjusting a torque of a drive roller which transports the recording medium based on a detection result of a tension of the recording medium in a first region where an image recording is performed on the recording medium; and a second control unit that controls the tension of the recording medium in a second region according to a detection result of the tension of the recording medium in a second region which is in an opposite side interposing the recording unit with respect to the drive roller; and causes the computer to function so that, compared to the frequency response characteristics of the first control unit with respect to the tension fluctuations generated in the first region, the frequency response characteristics of the second control unit with respect to the tension fluctuations generated in the second region respond to the tension fluctuations having a higher frequency band.

* * * * *